US005299962A

United States Patent [19]

Saulnier et al.

[11] Patent Number: 5,299,962

[45] Date of Patent: Apr. 5, 1994

[54] BUOY FOR STORING LINE CONNECTED TO UNDERWATER OBJECT

[76] Inventors: Kenneth Saulnier, R.R. #2, South Ohio, Yarmouth County, Nova Scotia, Canada, B0W 3E0; Hubert J. Van Leeuwen, 11 Princess Street, Amherst, Nova Scotia, Canada, B4H 1W5

[21] Appl. No.: 29,578

[22] Filed: Mar. 11, 1993

[30] Foreign Application Priority Data

Mar. 19, 1992 [CA] Canada ..... 2063544

[51] Int. Cl.[5] ..... B63B 22/18

[52] U.S. Cl. ..... 441/26; 441/30

[58] Field of Search ..... 441/1, 6, 21, 23, 24, 441/25, 27, 30; 114/254; 43/43.1, 43.11; 242/107, 115, 77

[56] References Cited

U.S. PATENT DOCUMENTS

| | | | |
|---|---|---|---|
| 2,515,715 | 7/1950 | Jones . | |
| 3,441,962 | 5/1969 | Williams | 441/25 |
| 3,827,093 | 8/1974 | Davis | 441/25 |
| 4,014,478 | 3/1977 | Bonacina | 441/25 |
| 4,074,380 | 2/1978 | Parker | 441/26 |
| 4,103,379 | 8/1978 | Wolfe . | |
| 4,238,864 | 12/1980 | Kealoha . | |
| 4,405,303 | 9/1983 | Smith | 441/25 |
| 4,778,422 | 10/1988 | Saulnier et al. | 441/26 |
| 5,087,216 | 2/1992 | Noggle | 441/26 |

*Primary Examiner*—Andres Kashnikow
*Assistant Examiner*—Stephen P. Avila
*Attorney, Agent, or Firm*—Beveridge, DeGrandi, Weilacher & Young

[57] ABSTRACT

A buoy is provided for storing a line connected to an underwater object, having a hollow casing formed of resilient plastics material and having two side portions each with bearings. A reel for carrying the line has shaft portions rotatable in the bearings. The reel is a buoyant hollow body also formed of flexible plastics material and is provided with a fluid inlet for inflation from an axially collapsed state, in which the reel and its shaft portions can be fitted between the side portions, to an inflated state wherein the shaft portions are rotatably held in the bearings.

6 Claims, 6 Drawing Sheets

BUOY FOR STORING LINE CONNECTED TO UNDERWATER OBJECT

BACKGROUND OF THE INVENTION

1. Field of the Invention

The present invention provides improvements in buoys especially buoys useful for lobster fishing, of the general type described in our U.S. Pat. No. 4,778,422 which issued Oct. 18, 1988. In this prior patent, a buoy was provided having a casing with two side portions connected together and with a reel rotatably mounted between the side portions and carrying a length of line connectable at its outer end to a lobster pot or other article, so that the line could be entirely contained within the buoy until the lobster pot or other article was deployed. Stowage of the line in this way prevented entanglements which were a common problem with the simple buoys and coils of line previously used in lobster fishing.

2. Prior Art

One feature of the buoy described in the aforesaid patent was that a central portion of one end of the reel was accessible through an aperture in the adjacent casing side portion, and this end of the reel shaft had a non-circular configuration adapted to be engaged by winding means such as a handle. The handle was removable when not in use. Another feature of this prior buoy was that the line was connected to the reel by a swivel link rotatable within a transverse bore in the reel so that when the line was fully paid out from the reel the buoy was free to rotate without causing entanglements.

Although it has been useful, the buoy of U.S. Pat. No. 4,778,422 did not prove sufficiently sturdy to be acceptable to all lobster fishermen; it could be broken by rough usage. Also, it was relatively expensive to manufacture. The present invention provides an improved buoy which overcomes these shortcomings of the previous design of buoy.

SUMMARY OF THE INVENTION

In accordance with the present invention, a buoy of the general kind described in the aforesaid patent, having a hollow casing part with two side portions and a reel with shaft portions rotatable in bearing means carried by the side portions, is modified in that the reel is made hollow and buoyant and is formed of flexible material and is provided with a fluid inlet so that it can be inflated. In an initial deflated or collapsed state the reel and its integral shaft portions can be fitted into the casing from outside, and the reel can then be inflated so that the shaft portions engage the bearing means to allow rotation therein.

In the present invention, therefore, the reel and shaft portions are integrally formed of a single piece of resilient material, preferably a hard rubbery plastics. Since the casing does not need to be assembled around the reel, the casing can also be integrally formed of similar material. Thus, both the casing and the reel are formed of resilient material which is not easily damaged in spite of rough treatment. Furthermore, the ends of the reel are preferably formed with opposed convex surfaces which are close to similarly shaped concave inner surfaces of the casing so that the reel can support the casing if the latter is subjected to large compressive loads.

As with the prior device, the reel and casing are such as to allow rewinding of the reel by placing a handle through an aperture in the side of the casing to engage a non-circular recess in the end of a reel shaft portion. Also, the line is attached to the reel via a rotatable link so that rotation of the buoy at the mooring point does not cause undue tangling of the line. A retaining clip is provided so that unwinding of the reel can be prevented, if required.

BRIEF DESCRIPTION OF THE DRAWINGS

The invention will further be described with reference to the accompanying drawings, in which.

DESCRIPTION OF THE PREFERRED EMBODIMENTS

Figure 1:
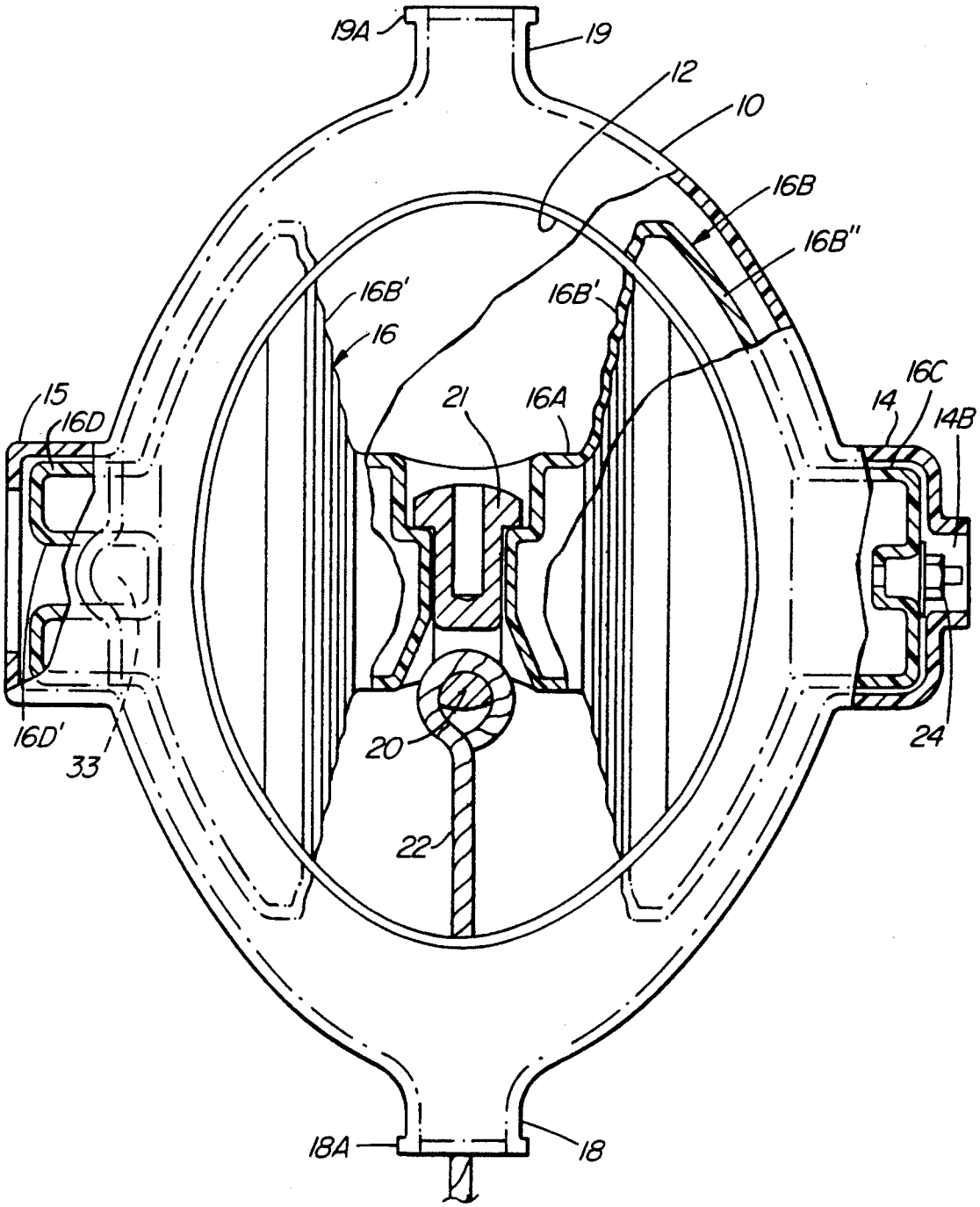
FIG. 1 shows a front view of the buoy, partially sectioned.
Figure 2:
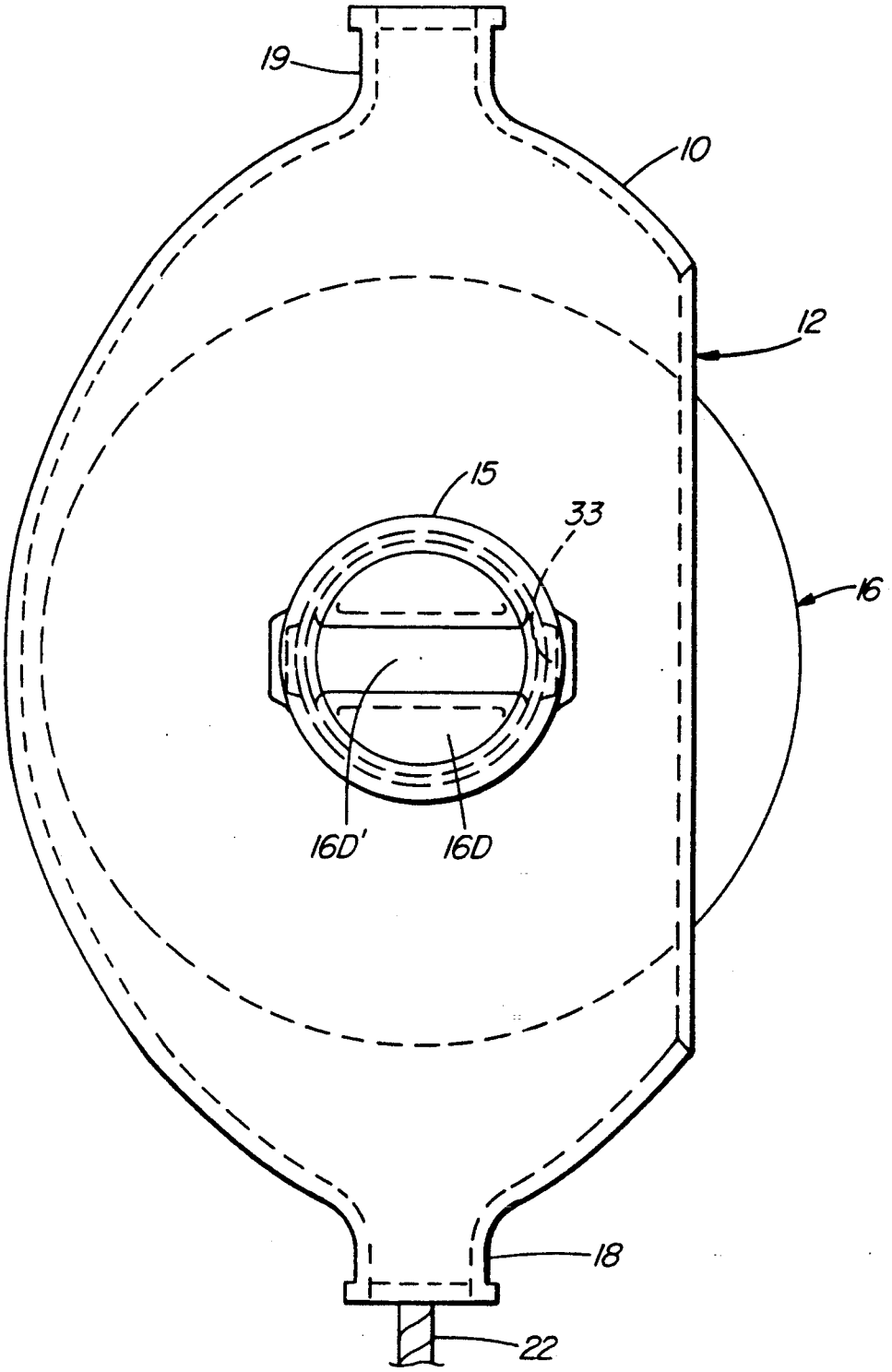
FIG. 2 shows a side view of the buoy.

Referring firstly to FIGS. 1 and 2, the buoy has a casing 10 which is integrally formed from a strong, resilient plastic such as high density polyethylene. The casing is in the general form of an ovoid with a large front aperture 12, and with side portions of the casing being provided with opposed cylindrical protrusions having internal recesses which provide bearings 14 and 15 for shaft portions 16C and 16D of a central reel 16. Both the cylindrical bearings 14 and 15 are centrally apertured to allow access to the ends of the shaft portions; bearing 14 provides a small central aperture **14*b* while bearing 15 allows access to the majority of the end of the shaft portion. At the top and bottom of the casing there are provided identical outlet guides for line, namely a lower outlet guide 18 and an upper outlet guide 19, each having a projecting flange 18A, 19A**.

The reel 16 is also hollow and is also formed of a resilient plastics, although this is preferably somewhat more flexible than the casing; suitable plastics may include polyolefins such as polyvinylchloride. The reel has a central, cylindrical shaft portion 16A, and two side flange portions 16B leading to the two end shaft portions 16C and 16D. The reel provides buoyancy for the whole buoy so that the buoy casing is not required to be buoyant.

The central shaft portion 16A has a transverse bore which receives a line securing bolt 20 having a head 21 rotatable in a recessed seat at one end of the bore. At the other end of the bore, the bolt has a transverse drilling which can receive the rope or line 22 which is secured thereto. The bolt 20 is rotatable in the bore, when not subjected to high stress, and this limits twisting and entanglement of the line. The bolt is no longer than the shaft diameter; during winding, the bolt will tend to centralize in the shaft portion so that no part protrudes substantially from the shaft. Shaft portion 16A has a length/diameter ratio of about unity so that it is sufficiently strong to resist bending, even though being hollow. In order to have enough strength, we prefer that the length/diameter ratio of shaft portion 16A be less than 1.5.

The two side flanges 16B have inner surfaces 16B' which diverge outwardly from the central shaft portion, and have outer surfaces 16B'' which are part spherical and which are disposed fairly close to and generally parallel to the concave inner surfaces of the casing. This arrangement is such that if the casing is subjected to very high stress, as for example when a buoy is used as a bumper between a boat and a wharf, the reel flange can provide some support for the casing and prevent breakage.

The shaft portion 16C is generally cylindrical but has a recess in its outer end which receives a check valve 24, designed to allow inflation of the reel with air and to hold the air in the reel until deliberately released. Apart from this, the reel is air tight. The material of the reel, and circular pleats provided on the inner surfaces of the reel flanges 16B' allows for the reel to be compressed axially when valve 24 is open. The axial compression is sufficient to allow assembly of the buoy by firstly compressing the reel axially, inserting this through the aperture 12 of the casing, allowing expansion so that the shaft portions enter the bearings, and finally inflating the reel to its final condition as shown, after which the valve 24 can be closed off. If need be, the valve 24 can be opened to release air and allow a reel to be changed.

Figure 3A:
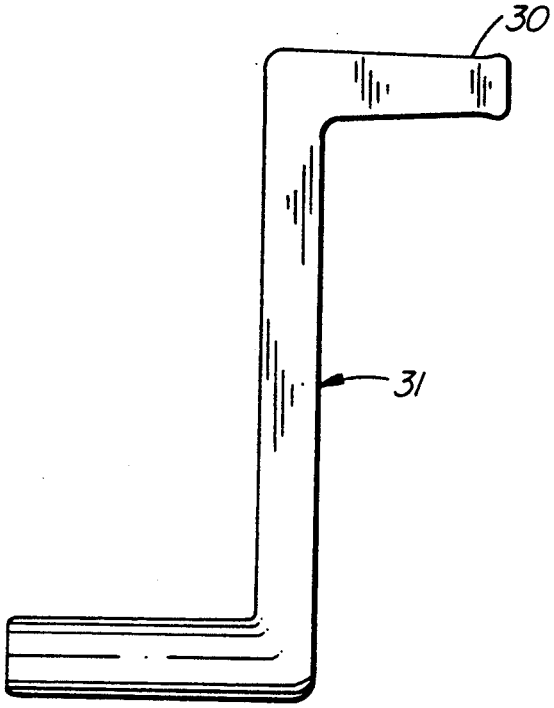
FIGS. 3A and 3B show views of a winding handle for the buoy.
Figure 3B:
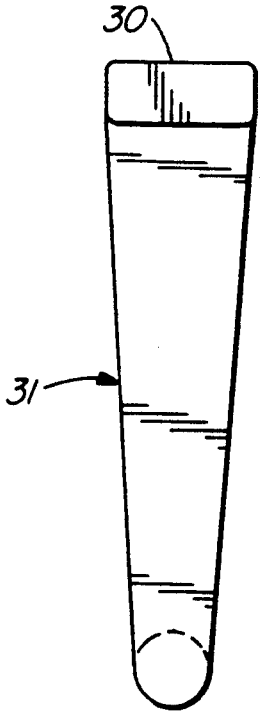

The shaft portion 16D is integrally formed with a large slot 16D' which extends across the whole width of this shaft end, i.e. it has open ends adjacent the inner surfaces of the associated bearing. This groove 16D' receives the flat end portion 30 of the handle 31 shown in FIGS. 3A and 3B, and which can be inserted for rewinding the reel when required. The handle is removed during normal operation of the buoy so that it does not become snagged on ropes or other parts; it may be noted that the reel has no projecting parts which could cause a similar problem.

Figure 4:
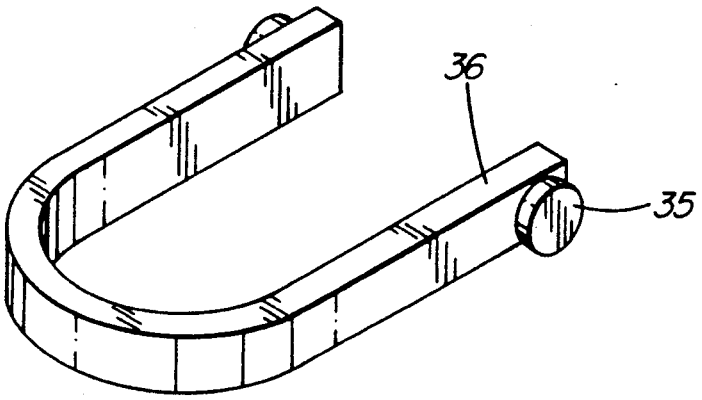
FIG. 4 shows a perspective view of a locking clip for preventing rotation of the reel.

In the position of the reel as shown, the ends of the groove 16D' are adjacent two small side recesses 33 in bearing 15, these recesses being seen in FIG. 2. These recesses can receive spigots 35 at the ends of a U-shaped retaining clip 36 shown in FIG. 4. To use this clip, it is compressed sufficiently to allow the lugs 35 to pass through the aperture in bearing 15, the ends of the legs passing into slot 16D', after which it is allowed to expand so that lugs 35 can engage in recesses 33. In this condition, the reel is locked from rotation.

In use for conventional lobster fishing, the line 22 is connected to a lobster pot and the handle 31 is used to wind in the reel so that almost all of the rope is stored on the reel. A lobster fishing boat can carry many of these buoy and lobster pot combinations without any danger of the ropes becoming entangled in each other or in other object. When it is desired to deploy the lobster pot, the buoy and pot combination is thrown overboard and the lobster pot sinks to the bottom while the line is paid out from the reel. After all of the line has been paid out the buoy is free to rotate relative to the buoy without entangling the rope, by reason of the rotatable link or bolt 20.

The buoy of this invention can also be used for so-called "trawl fishing", in which a series of lobster pots are connected by lines, and only the end-most pot has a buoy. In this case, the buoys can be used merely as storage means for line between two lobster pots, with a rope from one pot entering the lower guide 18 of the buoy, being wound around the reel and centrally attached to bolt 20, and leaving through the other guide 19. In this usage, the buoy remains completely under water but is useful for holding excess line in a tidy manner, and raised from the sea bed, instead of having this lying loosely or in coils.

As illustrated in FIGS. 5A, 5B, 5C, 6A and 6B, the guides 18 and 19 can be used to hold various other accessories for use with a buoy.

Figure 5A:
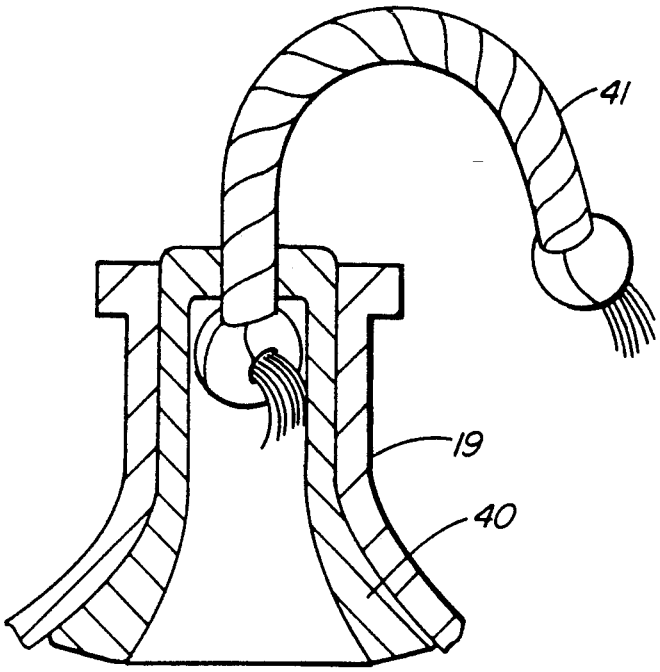
FIGS. 5A, 5B and 5C show three types of fitting which can be attached to the upper end of the buoy casing.
Figure 5B:
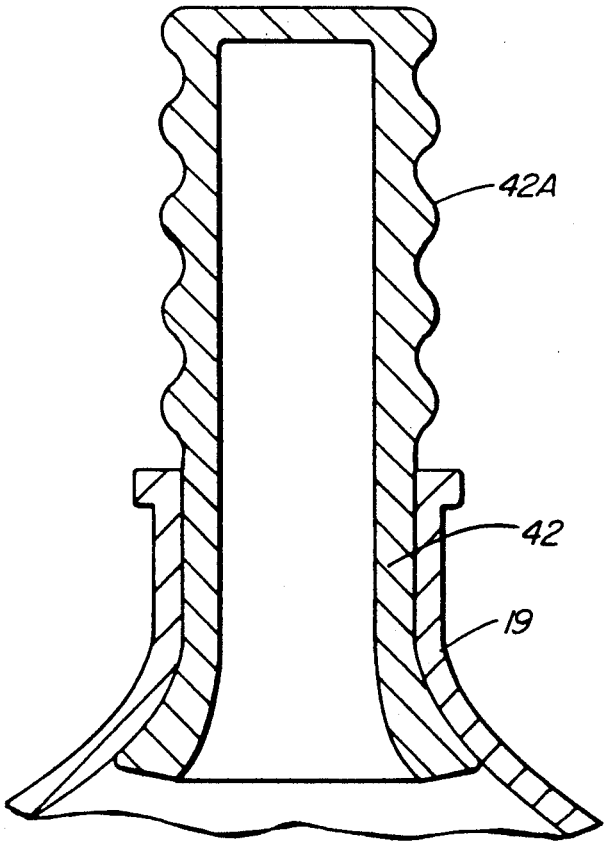
Figure 5C:
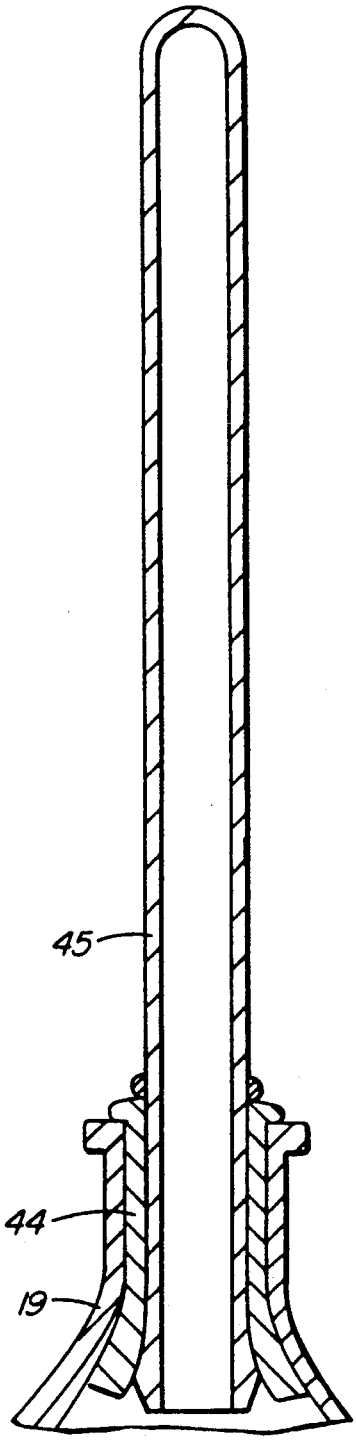

Firstly, FIG. A shows an adapter 40 inserted into the upper guide 19, the upper end of which holds a short length of rope 41 suitable as a lifting device for the buoy. Similarly, FIG. 5B shows an adapter 42 which has a lower part fitting into the guide 19 and an upper part 42A which serves as a handle. FIG. 5C shows a staff or mast device which includes an adapter part 44 which can be snapped into the upper end of the buoy and which holds an elongated mast 45 projecting upwardly from the upper end of the buoy. This mast can hold a flag, for example when being used to mark the position of a diver.

Figure 6A:
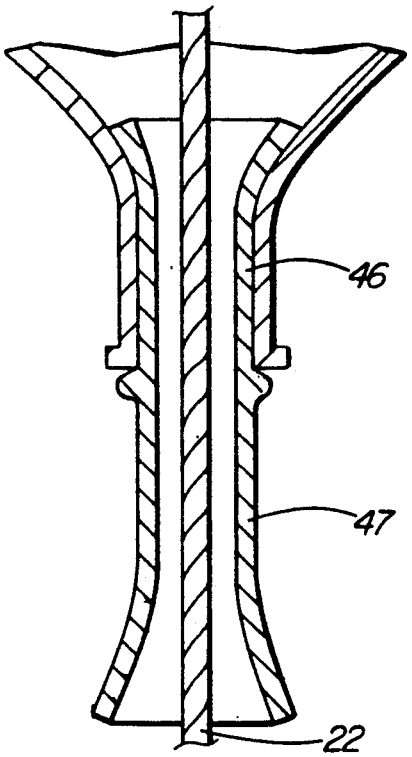
FIGS. 6A and 6B show fittings which can be attached to the lower end of the buoy casing, to act as ballast.
Figure 6B:
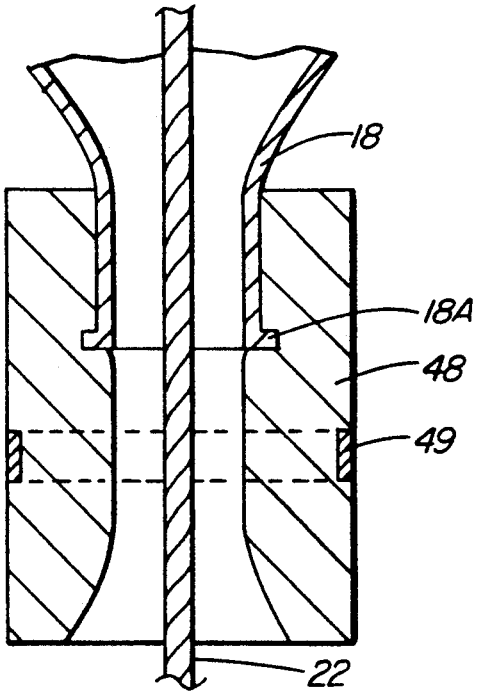

Although the buoy will tend to remain roughly upright by virtue of the pull on the line, it may be desirable especially when using a mast with a flag to add a ballast weight to the lower end of the buoy. Two means by which this can be done are shown in FIGS. 6A and 6B. In FIG. 6A a hollow tubular member 46 is arranged to be a snap-in fit in the rope guide 18 at the lower end of the buoy. This can be of heavy, corrosion resistant metal and provides not only a ballast weight but also a wear resistant guide for the rope. In FIG. 6B, a ballast weight 48 is shown which is formed in two halves, which can be fitted onto the lower end of the buoy, having a groove to accommodate flange 18A at this lower end. The two halves are held together by an encircling ring 49 which may be clamp such as a pipe clamp or an extensible band such as a rubber band.

It is anticipated that the casing and reel parts will be formed, in normal production, by rotational moulding or blow moulding. As an alternative to air inflation, the reel, when positioned in the casing, may be inflated by injection of a plastic foam. This would become hardened in use and prevent disassembly of the buoy.

There may be a need to limit the axial expansion of the reel during inflation so that it does not expand axially beyond the required limits, thus preventing proper rotation in the casing. Over extension in this manner can be prevented by providing flexible elements internally of the reel. These may be formed integrally with the reel material by conducting the blow moulding when the material is in a semi-plasticized state, in such a way that tendons or tendrils form during the inflation process. The tendrils may also be formed by an adhesive used between opposed parts of the reel which are sealed around the perimeter, with the adhesive hardening during the moulding.

It may be noted that since the reel can contain a foam plastic material, the term "hollow" does not preclude the reel containing a foam or like material which may become rigid after assembly of the buoy.

Figure 7:
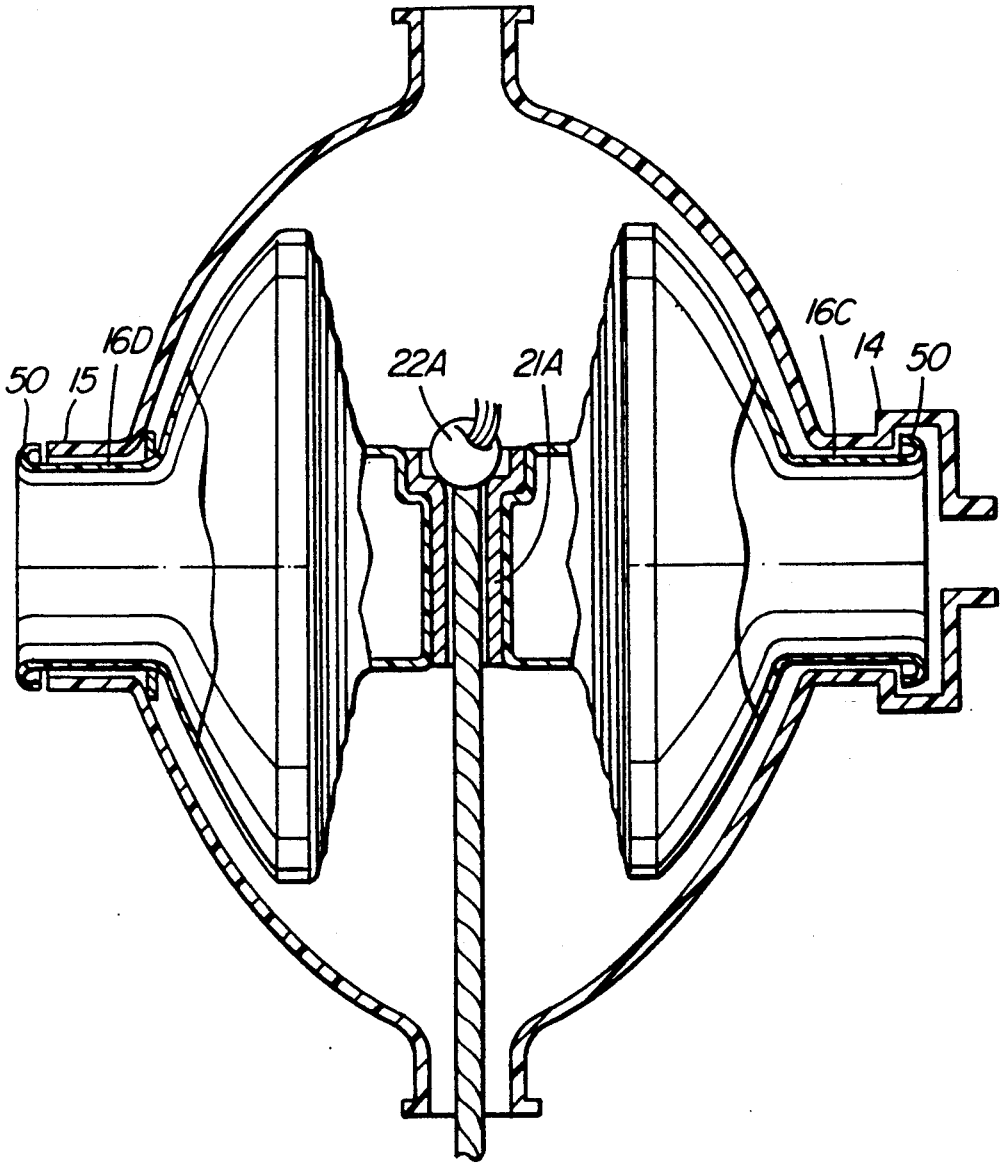
FIG. 7 shows a partially sectioned view through a modified form of the buoy.

FIG. 7 shows a further version of the buoy in which the reel shaft portions 16C and 16D have integrally moulded flanges 50 which snap in to the bearing 14 and 15. This version of the buoy also has a simple hollow bolt **21*a* holding the rope by means of a knot 22*a*** at the head of the bolt.

As described, the buoy casing has a single aperture 12 to allow insertion of the reel. This may be formed from an unapertured blow moulded casing by cutting the aperture with a laser. If desired, after insertion of the reel, the part cut out may be reinserted and welded back into place. The buoys would then have less drag. The rope guides 18 and 19 would in that case be made large enough for pin 21 to be inserted, with rope attached.

We claim:

1. A buoy for storing a line connected to an underwater object, of the type having two spaced side portions each with a bearing means and a reel for carrying the line which has shaft portions rotatable in said bearing means, wherein said reel is a buoyant hollow body formed of flexible material and is provided with a fluid inlet for inflation from a relatively axially collapsed state, wherein the reel and its shaft portions can be fitted between the side portions, to an inflated state wherein the reel is axially expanded so that its shaft portions are rotatably held in the bearing means.

2. A buoy according to claim 1, wherein one side portion has an aperture to provide access to one end of a reel shaft portion, said one end having a non-circular recess adapted to be engaged by winding means, and wherein said aperture has associated recesses which can be engaged by a retainer member inserted into said noncircular recess to prevent rotation of the reel.

3. A buoy for storing a line connected to an underwater object, having a hollow casing formed of resilient plastics material and having two side portions each with bearing means, and a reel for carrying the line having shaft portions rotatable in said bearing means, said casing having a lower guide outlet for line carried by the reel; and wherein said reel is a buoyant hollow body also formed of flexible plastics material and is provided with a fluid inlet for inflation from an axially collapsed state, in which the reel and its shaft portions can be fitted between the side portions, to an inflated state wherein the shaft portions are rotatably held in the bearing means.

4. A buoy according to claim 3, wherein the casing has an upper guide outlet for line in addition to the lower guide outlet so that a line having a central part fixed to the reel and wound thereon can extend both from the lower outlet and the top outlet.

5. A buoy according to claim 3, wherein the reel has flanges with outer convex surfaces which are sufficiently close to similarly shaped concave inner surfaces of the casing that the reel can support the casing if the latter is subjected to large compressive loads.

6. A buoy for storing a line connected to an underwater object, having a hollow casing formed of resilient plastics material and having two side portions each with bearing means, and a reel for carrying the line having shaft portions rotatable in said bearing means, said casing having a lower guide outlet for the line, said reel being a buoyant hollow body also formed of flexible plastics material and having, in its interior, a foamed plastics which maintains the shape of the reel so that its shaft portions remain in engagement with the bearing means, the reel acting both as buoyancy for the buoy and acting to rigidify the casing against compressive forces; and wherein the ends of the reel have convex surfaces which are sufficiently close to similarly shaped concave inner surfaces of the casing that the reel can support the casing if the latter is subjected to large compressive forces.

* * * * *